US009890480B2

(12) United States Patent
Dixon et al.

(10) Patent No.: US 9,890,480 B2
(45) Date of Patent: Feb. 13, 2018

(54) METHODS FOR PRODUCING CARBON FIBERS FROM POLY-(CAFFEYL ALCOHOL)

(71) Applicant: University of North Texas, Denton, TX (US)

(72) Inventors: Richard Dixon, Sulphur, OK (US); Nandika D'Souza, Plano, TX (US); Fang Chen, Denton, TX (US); Mangesh Nar, Denton, TX (US)

(73) Assignee: UNIVERSITY OF NORTH TEXAS, Denton, TX (US)

( * ) Notice: Subject to any disclaimer, the term of this patent is extended or adjusted under 35 U.S.C. 154(b) by 246 days.

(21) Appl. No.: 14/729,369

(22) Filed: Jun. 3, 2015

(65) Prior Publication Data

US 2015/0354100 A1 Dec. 10, 2015

Related U.S. Application Data

(60) Provisional application No. 62/008,424, filed on Jun. 5, 2014.

(51) Int. Cl.

| | |
|---|---|
| ***D01D 5/08*** | (2006.01) |
| ***D01F 9/20*** | (2006.01) |
| ***D01F 9/24*** | (2006.01) |
| ***D01F 9/17*** | (2006.01) |
| ***D01D 5/00*** | (2006.01) |
| ***D01F 9/16*** | (2006.01) |

(52) U.S. Cl.

CPC ..... *D01F 9/17* (2013.01); *D01D 5/003* (2013.01); *D01D 5/0023* (2013.01); *D01D 5/0038* (2013.01); *D01D 5/0046* (2013.01); *D01F 9/16* (2013.01); *Y10T 428/2918* (2015.01)

(58) Field of Classification Search

CPC .... D01D 5/0023; D01D 5/003; D01D 5/0038; D01D 5/0046; D01D 5/08; D01F 9/17; D01F 9/20; D01F 9/24

USPC ..... 264/29.2, 176.1, 465

See application file for complete search history.

(56) References Cited

U.S. PATENT DOCUMENTS 3,461,082 A 8/1969 Otani et al.
4,070,446 A 1/1978 Horikiri et al.

OTHER PUBLICATIONS

Ago, Mariko, et al.; Lignin-Based Electrospun Nanofibers Reinforced with Cellulose Nanocrystals; Biomacromolecules 13 (3), 918-926, 2012.

Baker, Darren A., et al.; On the Characterization and spinning of an organic purified lignin toward the manufacture of low-cost carbon fiber, Journal of Applied Polymer Science, 124, 227-234, Apr. 5, 2012.

Batouli, Seyed M., et al.; Environmental Performance of Kenaf-fiber Reinforced Polyurethane: a Life Cycle Assessment Approach, Journal of Cleaner Production 66,164-173, 2014.

Bhardwaj, Nandana, et al.; Electrospinning: A fascinating fiber fabrication technique; Biotechnology Advances, 28(3), 325-347, 2010.

Boerjan, Wout, et al.; Lignin Biosynthesis. Annual Review of Plant Biology 54, 519-546, 2003.

Chen, Fang, et al.; Novel seed coat lignins in the Cactaceae: structure, distribution and implications for the evolution of lignin diversity; Plant Journal 73, 201-211, 2013.

Chen, Fang, et al.; A polymer of caffeyl alcohol in plant seeds; Proceedings of the National Academy of Sciences; 109, 1772-1777, 2012.

Chen, Fang, et al.; Lignin modification improves fermentable sugar yields for biofuel production; Nature Biotechnology, 25(7), 759-761, Jul. 2007.

Chung, D.D.L.; Electromagnetic interference shielding effectiveness of carbon materials, Carbon, vol. 39, Issue 2, pp. 279-285, Feb. 2001.

Compere, A.L., et al.; Low cost carbon fiber from renewable resources; In International SAMPE Technical Conference (vol. 33, pp. 1306-1314), Aug. 2001.

Fong, H, et al.; Beaded Nanofibers Formed During Electrospinning; Polymer 40, 4585-4592, 1999.

Kadla, J.F., et al.; Lignin-based carbon fibers for composite fiber applications, Carbon 40, 2913-2920, 2002.

Kim, K.K., et al.; Dependence of Raman spectra G_band intensity on metallicity of single-wall carbon nanotubes; Physical Review B, vol. 76, No. 20, Article ID 205426, 2007.

Kubo, S., et al.; Lignin-based Carbon Fibers: Effect of Synthetic Polymer Blending on Fiber Properties, Journal of Polymers and the Environment, vol. 13, No. 2, Apr. 2005.

Kubo, S., et al.; Poly(Ethylene Oxide)/Organosolv Lignin Blends: Relationship between Thermal Properties, Chemical Structure, and Blend Behavior,; Macromolecules, 37, 6904-6911, 2004.

Kubo, S., et al.; Kraft lignin/poly(ethylene oxide) blends: Effect of lignin structure on miscibility and hydrogen bonding; J. Appl. Polym. Sci., 98: 1437-1444, 2005.

S. Kubo, et al.; Preparation of carbon fibers from softwood lignin by atmospheric acetic acid pulping; Carbon, vol. 36, Issues 7-8, pp. 1119-1124, 1998.

Lallave, Manuel, et al.; Filled and Hollow Carbon Nanofibers by Coaxial Electrospinning of Alcell Lignin without Binder Polymers; Advanced Materials, 19, 4292-4296, 2007.

(Continued)

*Primary Examiner* — Leo B Tentoni

(74) *Attorney, Agent, or Firm* — Jackson Walker LLP

(57) ABSTRACT

Poly-(caffeyl alcohol) (PCFA), also known as C-lignin, is a promising new source of both carbon fibers and pure carbon. PCFA can be used to produce carbon fibers by direct electrospinning, without blending with another polymer to reduce breakage. Analyses have shown that the carbon obtained from PCFA is superior to that obtained from other lignins. The fibers formed from PCFA are smoother, have a narrower diameter distribution, and show very low defects. The PCFA can be obtained by extraction from plant seed coats. Examples of these plants include the vanilla orchid, *Vanilla planifolia*, and *Jatropha curcas*. The fibers may be formed through electrospinning, although other methods for forming the fibers, such as extrusion with a carrier polymer, could be used. The fibers may then be carbonized to increase the carbon yield.

9 Claims, 6 Drawing Sheets

(56) References Cited

OTHER PUBLICATIONS

Lin, Jian, et al.; Chemical Thermostabilization for the Preparation of Carbon Fibers From Softwood Lignin, BioResources 7(4), 5634-5646, 2012.
Ma, Z., et al.; Controlling the selectivity to chemicals from lignin via catalytic fast pyrolysis, Applied Catalysis A: General 423-424, 130-136, 2012.
Mai, C., et al.; Chemo-enzymatic synthesis and characterization of graft copolymers from lignin and acrylic compounds, Enzyme and Microbial Technology 27, 167-175, 2000.
Mavinkurve, A., et al.; An initial evaluation of poly (vinylacetylene) as a carbon fiber precursor; Carbon, 33(6), 757-761, 1995.
Minus, M.L., et al.; The processing, properties, and structure of carbon fibers. JOM, 57(2), 52-58, 2005.
Newell, J.A., et al.; Factors limiting the tensile strength of PBO-based carbon fibers; Carbon, 34(5), 551-560, 1996.
Pierson, H. O., Handbook of carbon, graphite, diamond and fullerenes: properties, processing and applications, Noyes Publications (1993).
Rahaman, M.S.A., et al.; A review of heat treatment on polyacrylonitrile fiber. Polymer Degradation and Stability, 92(8), 1421-1432, 2007.
Reddy, M.S.S., et al.; Targeted down-regulation of cytochrome P450 enzymes for forage quality improvement in alfalfa (*Medicago sativa* L.); Proc Natl Acad Sci USA 102, 16573-16578, 2005.
Rose, Marcus, et al.; High surface area carbide-derived carbon fibers produced by electrospinning of polycarbosilane precursors, Carbon vol. 48, Issue 2, pp. 403-407, Feb. 2010.
Saito, N., et al.; Application of carbon fibers to biomaterials: A new era of nano-level control of carbon fibers after 30-years of development , Chem. Soc. Rev., 40, 3824-3834, 2011.
Sastri, S.B., et al.; Phthalonitrile-carbon fiber composites; Polymer Composites, 17(6), 816-822, Dec. 1996.
Snyder, James F., et al.; Evaluation of Commercially Available Carbon Fibers, Fabrics, and Papers for Potential Use in Multifunctional Energy Storage Applications, Journal of the Electrochemical Society, 156(3), A215-A224, 2009.
Sudo, K., et al.; A New Carbon Fiber from Lignin; Journal of Applied Polymer Science, vol. 44, 127-134, 1992.
Sudo, K., et al.; A New Modification Method of Exploded Lignin for the Preparation of a Carbon Fiber Precursor, Journal of Applied Polymer Science, vol. 48, 1485-1491,1993.
Tobimatsu, Y., et al.; Coexistence but independent biosynthesis of catechyl and guaiacyl/syringyl lignins in plant seeds; Plant Cell 25(7), 2587-2600, Jul. 2013.
Uraki, Y., et al.; Preparation of Carbon Fibers from Organosolv Lignin Obtained by Aqueous Acetic Acid Pulping; Holzforschung—International Journal of the Biology, Chemistry, Physics and Technology of Wood, 49.4, 343-350, 2009.
Vanholme, R., Metabolic engineering of novel lignin in biomass crops; New Phytologist, 196, 978-1000, 2012.
Venugopalan, R., et al.; Neutron irradiation studies on low density pan fiber based carbon/carbon composites; Journal of Nuclear Materials 404,19-24, 2010.
Wangxi, Z., et al.; Evolution of structure and properties of PAN precursors during their conversion to carbon fibers. Carbon, 41(14), 2805-2812, 2003.
Williams, G., et al. A self-healing carbon fibre reinforced polymer for aerospace applications, Composites Part A: Applied Science and Manufacturing, vol. 38, Issue 6, pp. 1525-1532, Jun. 2007.
Xiao, B., et al.; The chemical modification of lignins with succinic anhydride in aqueous systems, Polymer Degradation and Stability, vol. 71, Issue 2, pp. 223-231, 2001.
Hill, Jason, et al.; Climate Change and Health Costs of Air Emissions from Biofuels and Gasoline; PNAS, 106(6), 2077-2082, Feb. 2009.
Nar et al., "Superior Plant Based Carbon Fibers From Electrospun Poly-(Caffeylalcohol) Lignin", Carbon, 2016, pp. 72-383, vol. 103, by Elsevier Ltd.

A

B

A

B

C

D

A

B

A

B

METHODS FOR PRODUCING CARBON FIBERS FROM POLY-(CAFFEYL ALCOHOL)

This application claims priority to U.S. Provisional Patent Application Ser. No. 62/008,424, entitled "Carbon Fibers Derived From Poly-(Caffeyl Alcohol) (PCFA)," filed on Jun. 5, 2014, the entire content of which is hereby incorporated by reference.

BACKGROUND

This disclosure pertains to plant-sourced carbon. In particular, this disclosure relates to poly-(caffeyl alcohol) ("PCFA"), also named as C-lignin as a source for carbon.

Carbon fibers are a high volume high performance product in applications ranging from carbon fiber reinforced epoxy for aerospace and marine applications, electromagnetic interference shielding, biomedical applications for regenerative medicine and cancer treatment, energy storage devices and water filtration. Recently, concerns about greenhouse gas emissions and climate change have motivated a shift to lighter automobiles. To this end, significant efforts are being focused on the development and deployment of carbon fiber-reinforced composites. Modeling studies have indicated that over 60% of the steel in a vehicle could be replaced by carbon fiber-reinforced composite materials, dramatically reducing its weight while maintaining the vehicle's impact protection. Furthermore, for every 10% reduction in weight of the vehicle, the fuel economy is estimated to increase by 6%.

Carbon fiber composites (CFCs) display several properties that are very attractive in structural applications: high strength and stiffness, low density, they are chemically inert and show high electrical and thermal conductivity. However, methods for producing these CFCs are less than ideal. Currently, carbon fiber is manufactured predominantly from polyacrylonitrile (PAN) with a small fraction originating in pitch. PAN based on the acrylonitrile monomer has a high cost. Pitch raw materials are cheaper but the processing involves cleanup leading to high final cost. Pitch from petroleum is preferred over coal pitch from raw material clean up perspectives, but needs vacuum cleaning to remove volatile matter. To form carbon fibers, wetting of PAN prior to carbonization is employed. Typical carbon yields for PAN-based and pitch-based carbon fibers are about 50-60% and 70-80% respectively. A pre-oxidation step to carbonization has been shown to result in higher carbon yield, and additional graphitization with argon has increased the carbon yield to 80% for PAN fibers.

Synthetic polymers such as polyacetylene, polyethylene, and polybenzoxazole have also been investigated as a potential route for obtaining carbon fibers. While the strength to weight ratio of these polymers exceeds that of glass, the cost/weight ratio remains prohibitive. Thus, fiberglass based composites remain the high volume product. This raises further environmental concerns as the carbon footprint for producing fiberglass is prohibitive. Because of such concerns, development of a source of carbon fiber based on plant material is being strongly promoted.

Kraft lignin, extracted from hardwoods, has been extensively studied as a feedstock for biomaterials. To facilitate the melting of the lignin, organic solvent based extraction, chemical treatment or melt blending are employed. The value of lignin as a source for carbon fibers obtained from melt and dry spinning of hardwood Kraft lignin (HKL), softwood Kraft lignin (SKL) and alkali softwood Kraft lignin has been shown. Hydrogenation with NaOH using Raney-Ni, followed by steam explosion to isolate the lignin and then modification to lower its softening point, thereby facilitating melt spinning of the fibers, has been used. However, this method was expensive and a cheaper alternative was attempted using creosote for phenolysis. Although phenolysis improved the yield to 40%, tensile properties were low when compared to hydrogenation. Acetic acid pulping from hardwood gave fusible lignin that could be melt-spun. Lignin from softwood resulted in a high fraction of high molecular weight infusible lignin, that must be separated from the fusible fraction in order to facilitate melt spinning.

Chemo-enzymatic treatment (sulfonication) has been shown to transform water insoluble Kraft and organosolv lignins to water soluble material, and facilitates grafting of acrylic compounds onto the lignin backbone. Esterification of lignins from sources such as palm trunk, poplar, maize, barley, wheat, and rye with succinate anhydride showed relatively lower substitution of succinate, but gave thermal stability ranging from 100 to 600° C., with the highest for lignin from rye.

Blending polymers with lignin enables fiber integrity through improved melt strength. Poly(ethylene oxide) (PEO) has been widely studied for imparting ability for spinning lignin into fibers. Incorporation of 5% and 3% PEO in hardwood Kraft lignin (HKL) improved spinning capability and tensile properties, respectively. With an Alcell/PEO blend, strong hydrogen bonding results in miscible blends aiding spinning of fibers, although addition of PEO did not improve the mechanical properties of the fiber. To overcome brittleness, lignin was blended with polyethylene terephthalate (PET) and polypropylene (PP). Blends of PET and PP with HKL gave fiber diameter ranges from 30 to 76 μm, and blends with 25% polymers yielded 60% carbon after carbonation; however, this route did not improve the physical properties of the fibers. Similarly, polyethylene glycol (PEG)-lignin was used for single needle melt spinning to obtain 23 μm diameter fibers at 170° C. and PVA by researchers in the field.

The above examples clearly demonstrate that considerable processing is necessary to obtain high carbon yields, good spinnability and useful fiber properties from typical bulk lignin, such as the Kraft lignin obtained as a by-product from the pulp and paper industry.

SUMMARY

The present disclosure relates generally to carbon fibers derived from poly-(caffeyl alcohol) (PCFA), also known as C-lignin, and to methods for preparing the carbon fibers. The carbon fibers derived from PCFA are 100% PCFA with no carrier polymer and demonstrate properties superior to other commercially available carbon fibers such as those derived from Kraft lignin.

Lignocellulose is a dominant constituent of plant dry matter, consisting of a complex of cellulose and hemicellulose embedded in lignin. Lignin is the second most abundant natural polymer on earth, produced by oxidative polymerization of p-hydroxycinnamyl alcohols (monolignols). Lignins are primarily found in plant secondary cell walls, and are particularly abundant in vascular tissues. The presence of this lignin reduces forage digestibility and hinders agro-industrial processes for generating pulp or biofuels from lignocellulosic plant biomass, and there has therefore been considerable attention given to reducing lignin content in plant feedstocks. In general, lignin polymers found in stem tissues are composed of three units; p-hydroxyphenyl (H, generally a minor unit), guaiacyl (G), and syringyl (S) units. These are derived biosynthetically from p-coumaryl, coniferyl, and sinapyl alcohols. These units are joined in the polymer through a range of different linkage types, resulting in a branched polymer that is also cross-linked to cell wall polysaccharides. Compared to PAN and pitch precursors, lignin is cost effective and has an aromatic structure that is carbon rich for higher carbon yield. There is therefore considerable interest in determining whether lignin can be developed as a cost-effective feedstock for carbon-based applications, potentially as a byproduct of the processing of lignocellulosic liquid biofuels.

It has been discovered that the seed coats of a variety of plant species contain a previously unsuspected class of lignin-like molecule made entirely from caffeyl alcohol units (essentially G units lacking the methyl group on the 3-oxygen). This molecule is termed C-lignin or poly-(caffeyl alcohol) (PCFA). The ortho-dihydroxy substitution of the caffeyl alcohol monomer results in polymerization to yield a linear homopolymer containing benzodioxane rings. Without wanting to be bound by theory, such a linear structure appears to enhance the ability to generate carbon fibers by electrospinning.

Significantly, PCFA can be used to produce carbon fibers by direct electrospinning, without blending with another polymer to reduce breakage. In contrast, Kraft lignin is generally blended with another polymer to increase the extensional flow strength and allow long spools of uniform fiber to be produced without breakage. This is an advantage for the use of a C-lignin precursor rather than Kraft lignin. Analyses have shown that the carbon obtained from PCFA is superior to that obtained from Kraft lignin. The fibers formed from PCFA are smoother than those from Kraft lignin, have a narrower diameter distribution, and show very low defects compared to Kraft lignin. Carbon defects are associated with inferior mechanical and thermal properties. Thus the carbon fibers derived from PCFA appear to be far superior to the Kraft lignin sourced carbon.

The carbon fibers derived from PCFA would be useful in composites for everything from aircraft, cars, sports rackets, to water purification devices, and could be developed as high value co-products from lignocellulosic biofuels.

DETAILED DESCRIPTION OF PREFERRED EMBODIMENTS

Figure 1:
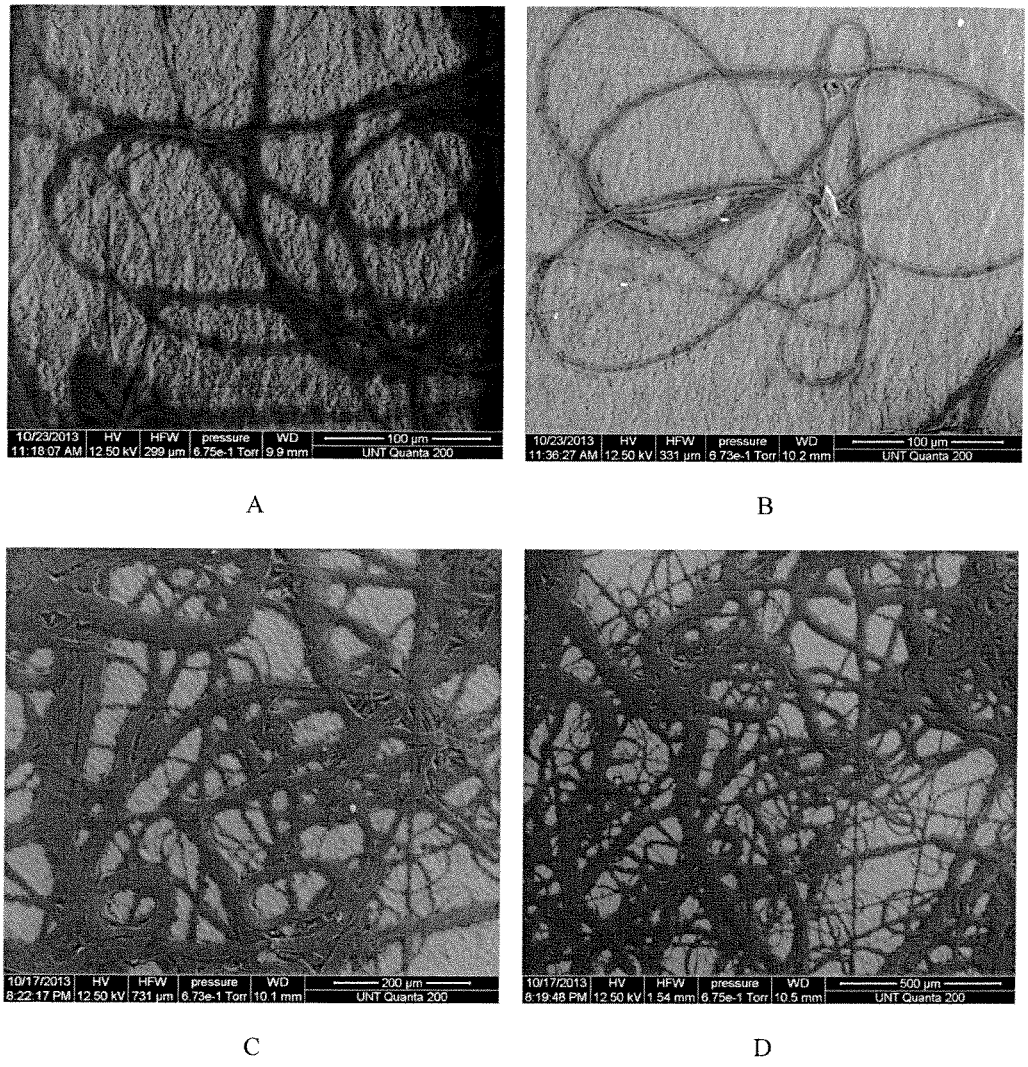
FIG. 1 shows ESEM images of electrospun PCFA fibers (A,B) and Kraft fibers (C,D)

Generally, the present disclosure relates to carbon fibers derived from poly-(caffeyl alcohol) or PCFA and the methods for preparing these fibers.

In preferred embodiments, the carbon fibers are made up of 100% PCFA with no carrier polymer. Alternatively, the carbon fibers may be made up of about 10% to about 90% PCFA in combination with a polymer carrier PAN, polyesters, polyolefins, polyamides and other thermoplastic and thermoset polymers can be used.

The PCFA is preferably obtained by plant extraction from any plant that has PCFA in its seed coats. Examples of these plants include the vanilla orchid, *Vanilla planifolia*, and *Jatropha curcas*. Any suitable method for extraction can be used. The fibers may be formed through electrospinning, although other methods for forming the fibers, such as extrusion with a carrier polymer, could be used. The fibers may then be carbonized to increase the carbon yield.

In the present disclosure, PCFA was extracted from the ground seed coats of *Vanilla planifolia* using an alkaline solvent and the lignin was precipitated from solution. In parallel, Kraft lignin was precipitated from the black liquor obtained from the paper and pulping industry. 50% solutions of each sample in dioxane were prepared and electrospun through a syringe needle to which a voltage has been applied. Neither lignin sample was blended with other polymers to facilitate electrospinning. The spun fibers were then carbonized. This process resulted in similar carbon yields for PCFA and Kraft lignin. However, the electrospinning process produced more continuous fiber with a narrower size distribution in the case of PCFA compared with Kraft lignin. Both lignins produced fibers of higher percentage crystallinity (by Raman spectroscopy) than PAN-based carbon fibers, with PCFA fiber showing the highest crystallinity, consistent with its more linear molecule. The higher purity of PCFA and Kraft fibers over PAN-based fibers is expected to translate into higher mechanical stiffness, thermal and electrical conductivity.

Generally, PCFA offers a linear molecular architecture that helps enable the formation of fibers. The fiber formed from Kraft lignin has high surface roughness compared to the smooth PCFA carbon fibers. PCFA based carbon fiber also shows very low defects compared to Kraft lignin. Carbon defects are associated with inferior mechanical and thermal properties. Finally, higher ionic conductivity of Kraft lignin points to remnant impurities and complex sources of the originating liquid compared to that of PCFA.

This disclosure pertains to the fabrication of PCFA-based carbon fiber. As shown more fully in the examples below, Kraft lignin has been used as a comparative basis for examining the carbon fiber obtained from PCFA. Notable is that the PCFA fibers were successfully electrospun directly from solutions without any chemical treatment or addition of polymers to provide fiber extensional flow strength to produce uniform fibers. As reported previously, Kraft lignin in the unmodified state produced fibers that were of high diameter (~50 μm) and exhibited surface roughness. In contrast, the PCFA-sourced carbon fibers were of low diameter (~10 μm) and smooth. Manufacture of Kraft lignin based carbon has utilized co-axial electrospinning to enable melt strength for long fiber spools to be formed, and the porosity has been used for activated carbon. However, smooth PCFA-based carbon fibers can be obtained by direct electrospinning with no fiber breakage.

Carbonization at 900° C. imparted more graphitic properties to the PCFA carbon than to the Kraft lignin, as seen in the Raman spectroscopy analysis described below, with G/D ratios of 1.92 vs 1.15 respectively. In this respect, the PCFA-derived carbon compares very well to commercial carbon from PAN and approaches that based on pitch. The carbon yield is around 86% for both sources of carbon. Zeta potential shows good dispersion stability in DI water for carbon from both fibers. On the basis of the results of the analyses described below, PCFA appears to be a promising new source of both carbon fibers and pure carbon.

Example 1. Extraction of PCFA

PCFA (C-lignin) was obtained from seed coats of *Vanilla planifolia*. Vanilla seeds were ground to a powder using a Freezer/Mill 6870 (SPEX Sample Prep, Metuchen, N.J.), then extracted with chloroform and methanol three times consecutively. To isolate PCFA, the extracted seeds were mixed with 1% NaOH in a liquid to solid ratio of 10. The mixture was then heated to 120° C., and the temperature maintained at 120° C. for one hour in an autoclave. After cooling, the black liquid was separated from the residue by filtration, and PCFA was precipitated from the liquid phase by adjusting the pH to 3.0 with concentrated HCl. The precipitated PCFA was separated by centrifugation, washed with water and freeze dried.

Example 2. Extraction of Kraft Lignin

The kraft lignin extraction process was as follows. Black liquor with pH 11.0 and total solids 88.9%, Klasson lignin 25.1%, and ash 63.8% was received from Zellstoff Pöls AG, Austria. The black liquor was produced as by-product during sulphate pulping of 70% spruce, 25% pine and 5% larch. Kraft lignin (KL) was isolated from black liquor by acid precipitation with 37% hydrochloric acid. After lowering the pH to 2, the precipitated sample was filtered on a Buchner funnel and washed with distilled water twice, to remove unreacted compounds. The filtered sample was dialyzed against fresh distilled water for 7 days, and subsequently was freeze dried.

Example 3. Comparative Chemical Analyses of Lignin Samples

The purity of Kraft lignin samples was determined from the analyses for Klason lignin, acid-soluble lignin and ash according to Tappi Standard procedures (T 13 m-54, T 222 om-02, and T 15 os-58). The composition of lignin samples was determined by elemental analysis for C, H, N and S contents by a Universal-Elemental analyser Vario El III (Elementar, Germany). The results of elemental analysis and ash were used to calculate lignin $C_9$ formulae. Average molecular weights ($\overline{M_n}$ and $\overline{M_w}$), and polydispersity PDI ($\overline{M_w}/\overline{M_n}$) were determined by gel permeation chromatography (GPC) instrument equipped with L6000A Merck-Hitachi pump, PPS sizing column (5 μm, 8×50 mm), three linear PPS gel columns (5 μm, 8×300 mm) connected in series, and a Viscotek differential refractometer/viscometer (Malvern, UK). The columns were calibrated using a series of 12 narrow molecular weight polystyrene standards with molar mass ranging from 680 to 1 600 000 g/mol (Polymer Standard Service). The samples were dissolved in tetrahydrofurane at concentration 4 mg/ml and were analysed at room temperature. THF was used as eluent at flow rate of 1.0 ml/min and the injection volume was 100 μl. The results are shown below in Table 1.

TABLE 1

| Kraft Lignin Sample | |
|---|---|
| Klason lignin (wt %)[a] | 89.6 |
| Total lignin content (wt %)[b] | 92.5 |

TABLE 1-continued

| Kraft Lignin Sample | |
|---|---|
| Ash (wt %) | 0.2 |
| Carbon (wt %) | 64.1 |
| Hydrogen (wt %) | 5.6 |
| Nitrogen (wt %) | 0.1 |
| Sulphur (wt %) | 2.4 |
| Molecular weight | 1749 |
| Polydispersity | 2.38 |

[a]Estimated by difference
[b]Klason lignin with acid soluble lignin part

Example 4. Electrospinning and Carbonization

A 50% solution of PCFA was prepared in 1,4 dioxane (boiling point of 101° C.). The powder was mixed at 50° C. for 4 h, and then transferred to the syringe for electrospinning. The same process was repeated for Kraft lignin. A 5 ml syringe (National Scientific, Rockwood, Tenn., Model #57510-5) with an 18 gauge (1.27 mm) 1" long stainless steel blunt needle with a Luer polypropylene hub was used. The syringe with needle was placed on a Razel syringe pump (Model #R99-FM, Razel Scientific Instruments, St. Albans, Vt.). The rate of syringe pump was 0.763 with a flow rate of 2.65 ml/h, the distance between the needle and the plate was 20 cm and the voltage was 20 kV. The solution was pumped from the syringe. The needle was then charged to the prescribed voltage using a high voltage power supply (Model #ES30P-5W/DAM, Gamma High Voltage Research Inc., Ormond Beach, Fla.). The collector plate was set at the prescribed distance from the needle, covered with non-stick aluminium foil, and grounded. As the syringe pump and the high voltage power supply were switched on, the lignin solution came out of the needle forming a Taylor cone that was attracted by the electrostatic force towards the grounded collector plate.

The electrospun fibers from PCFA and Kraft lignin were subjected to carbonization in a horizontal tube furnace. The heating and cooling ramp rate was set at 5° C./min. Fibers were held at 900° C. for 45 min under a flow of nitrogen of 0.5 standard cubic feet per hour (SCFH). The carbon obtained was analyzed for carbon yield.

Example 5. Comparative Analyses

Environmental Scanning Electron Microscopy (ESEM):

A FEI Quanta Environmental Scanning Electron Microscope (ESEM; FEI Company, Oregon, USA) was used to image the cross section of the burnt PCFA and Kraft lignin fibers at an accelerating voltage of 12.5 kV at 10 mm working distance. The samples were sputter coated with gold-palladium to make them conductive and make imaging possible.

Raman Spectroscopy:

A 532 nm intensity laser was used at 25% power with aperture of 10 μm slit and objective lens with 10× zoom to give a spot size of 2.1 μm. The scan was done from 750 to 2000 l/cm. The exposure time was 15 sec. Background and sample exposure was performed five times. Background was collected before every sample. This background was subtracted from the Raman spectroscopy results and a baseline correction was performed.

Zeta Potential:

A Delta NanoC particle analyzer from Beckman Coulter (Pasadena, Calif.) was used to determine Zeta potential. The dispersions of the PCFA powder and Kraft lignin were made in deionized water at room temperature and dispersed using sonication for 1 h.

Results:

Solutions of both PCFA and Kraft lignin are electrospinnable. Continuous electrospun fibers were obtained under conditions of 20 kV and 2.65 cc/h solution flow rate with a distance of 20 cm to the stationary collector plate. The ESEM images of PCFA (FIG. 1A, 1B) and Kraft lignin (FIG. 1C, 1D) suggest that the fibers obtained are highly uniform with no beads. Obtaining bead-free fibers depends on the conductivity of the solution which elongates the Taylor cone formed at the tip of the needle to give electrospun fibers. During electrospinning of both PCFA and Kraft lignin a minimum voltage of 20 kV was essential to overcome the surface tension of the Taylor cone. A 50% solution in 1,4 dioxane at 50° C. gives enough entanglement of PCFA to spin it into fibers.

Figure 2:
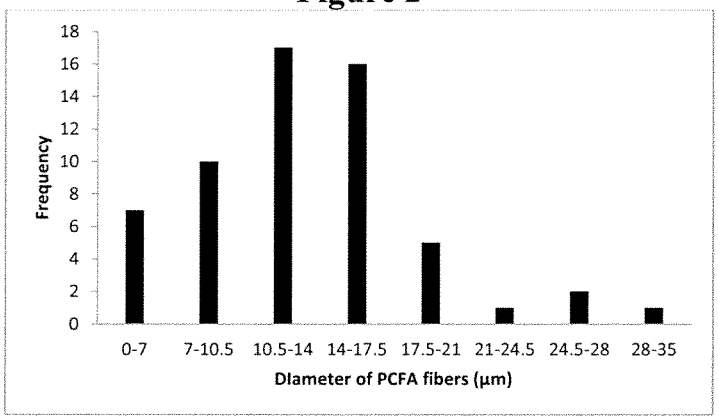
FIG. 2 shows histograms of the diameters of electrospun PCFA fibers (A), and Kraft lignin fibers (B)
Figure 2:
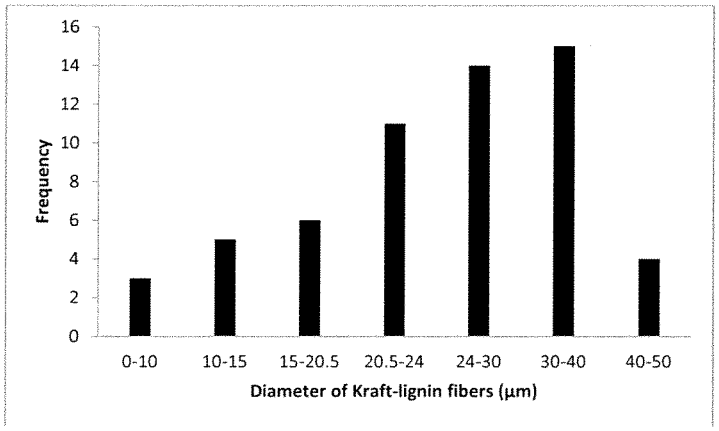

The ESEM images were analyzed using ImageJ® software (NIH). The images were corrected for the scale from pixels of the original tiff image to the known distance on the image to calibrate for scale. A total of 58 measurements of diameters were made and the histogram was plotted for the most frequent occurrence of the diameter range, as shown in FIG. 2. PCFA produced fine uniform fibers and processed unceasingly compared to Kraft lignin which could only electrospin for a short period of time. The diameters of the electrospun fibers from PCFA and Kraft lignin were in the range of 10.5 to 14 μm and 30 to 40 μm, respectively.

Figure 3:
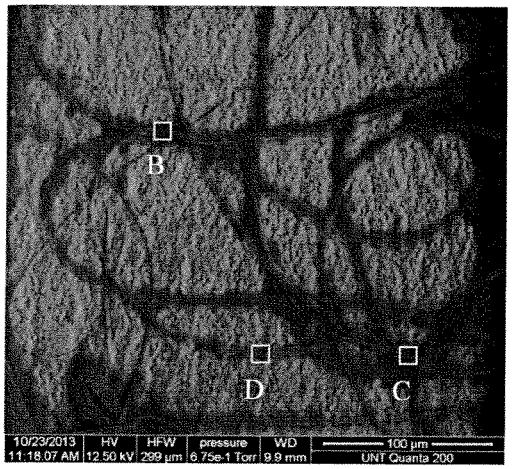
FIG. 3 shows (A) ESEM image of electrospun PCFA fibers and (B, C and, D) surface variation analysis for the areas marked with open yellow rectangle in (A)
Figure 3:
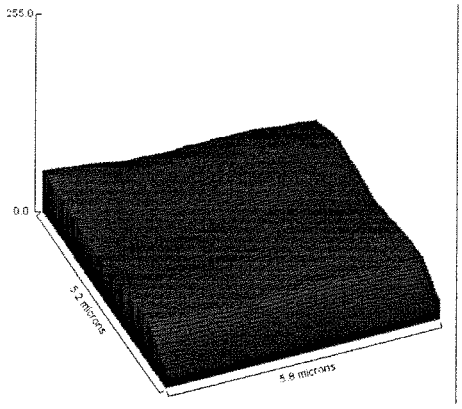
Figure 3:
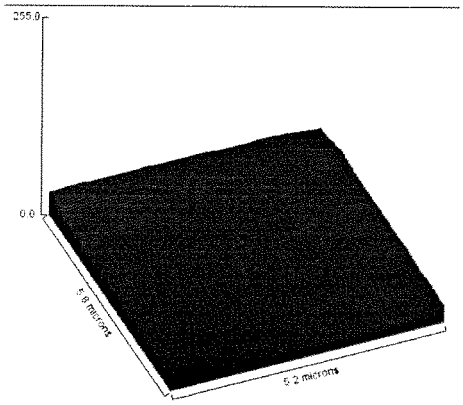
Figure 3:
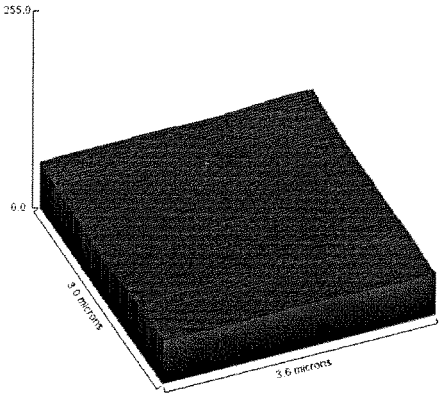
Figure 4:
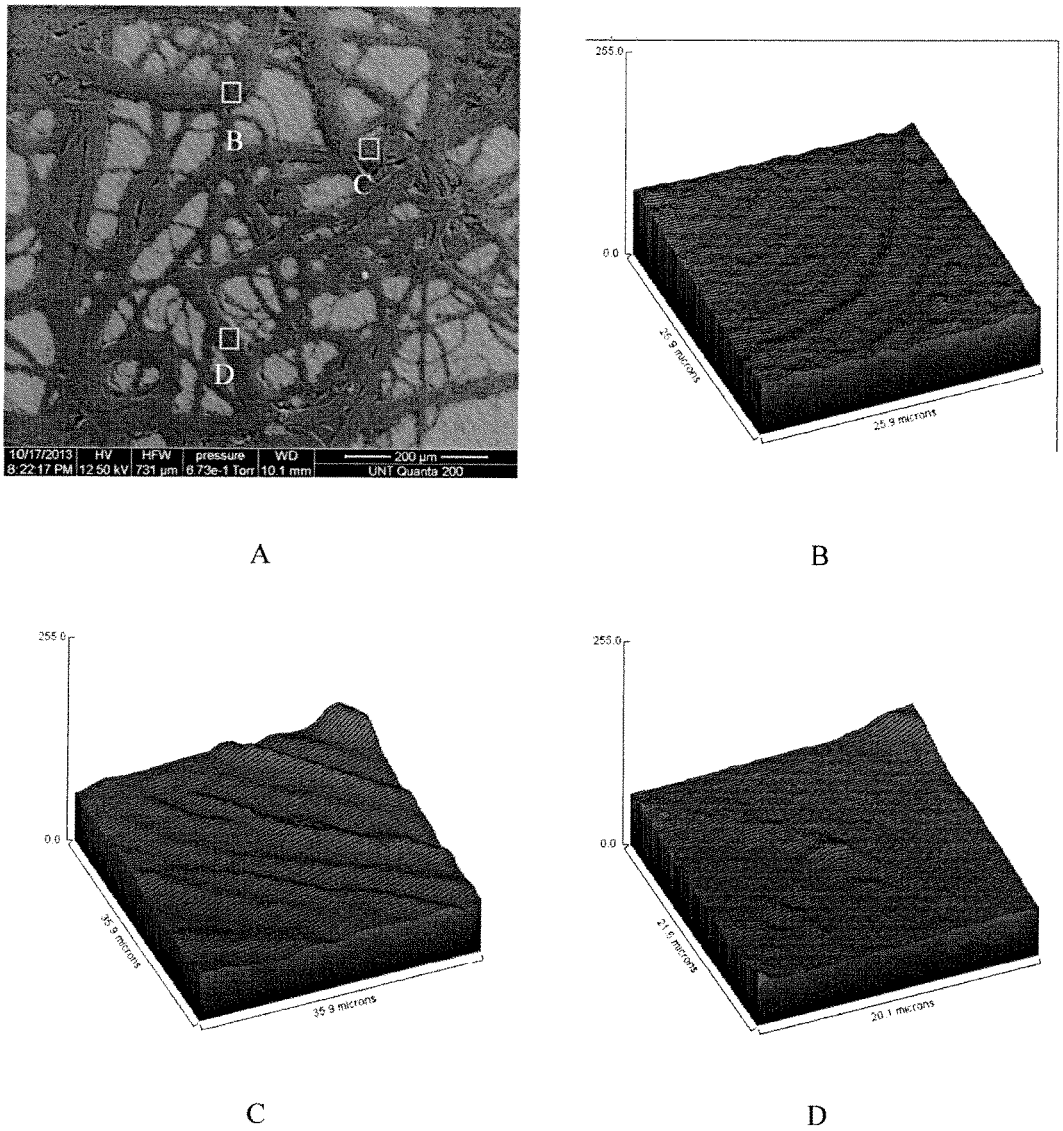
FIG. 4 shows (A) ESEM image of electrospun Kraft lignin fibers and (B, C and, D) surface variation analysis for the areas marked with open yellow rectangle in (A)

ESEM images of PCFA and Kraft lignin were also analyzed for surface variation. As shown in FIGS. 3 and 4, the surface is significantly smoother in the PCFA lignin compared to the Kraft lignin sourced carbon fibers.

Figure 5:
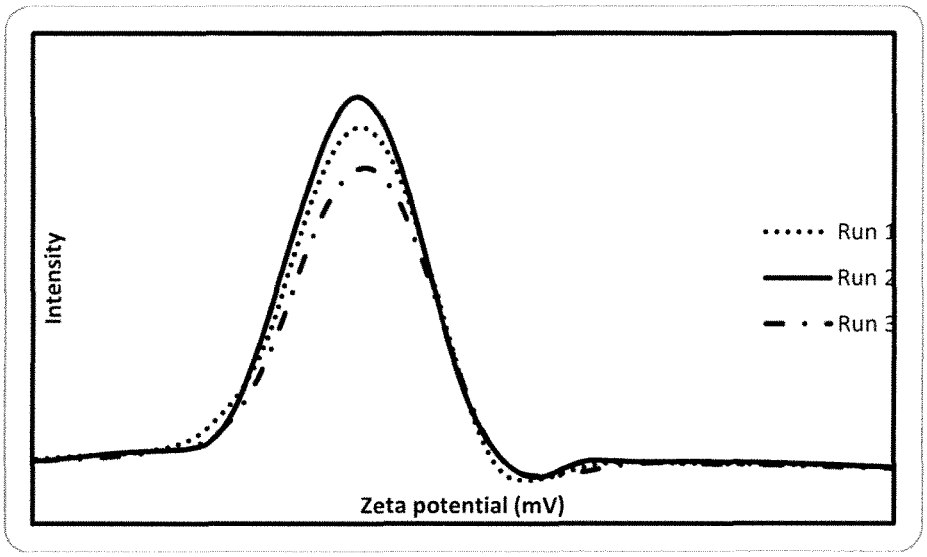
FIG. 5 shows Zeta potentials for carbon from (A) PCFA powder and (B) Kraft lignin.
Figure 5:
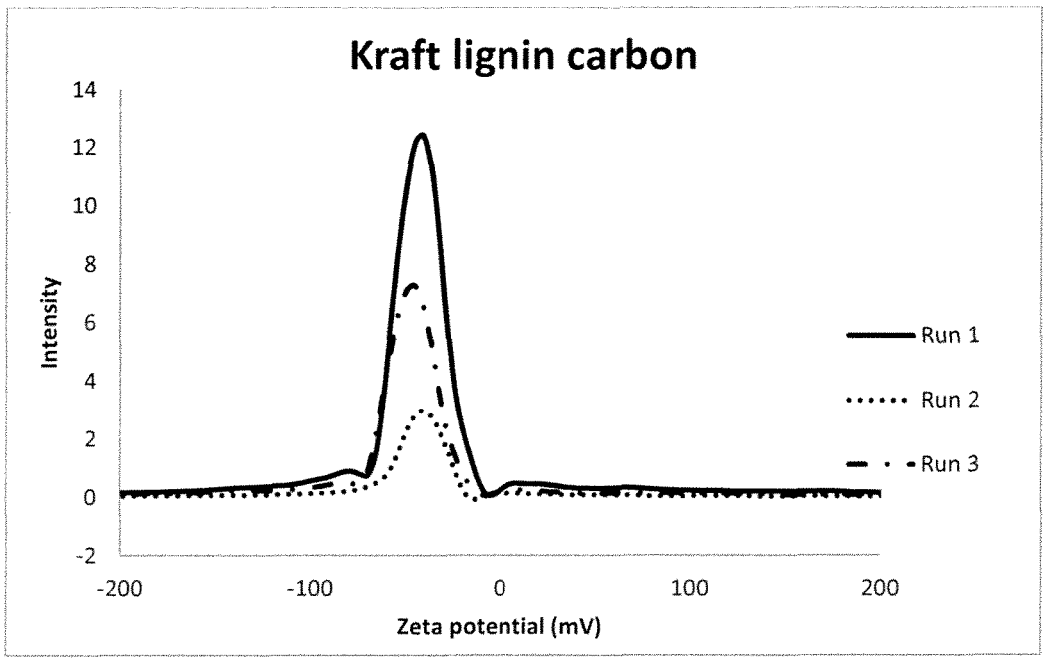

As shown in FIG. 5, the Zeta potentials for PCFA and Kraft lignin carbon powders in deionized water are similar, around −43.35±0.48 mV and −42.05±2.37 mV respectively. This suggests that the stability of the carbon particles obtained from PCFA is good enough to keep them in suspension for long durations. The Zeta value indicates repulsion between the particles, thus stopping them from attracting each other and flocculating. The low mobility and conductivity values indicate that the ionic double layer is thick due to low ionic strength. The mobility of the particles in the suspension, 3.40e-004±00 $cm^2/Vs$, indicates that the attraction of particles to the electrodes is very low. Table 2 below shows the suspension properties of carbon from PCFA and Kraft lignin.

TABLE 2

| Sample | Zeta potential (mV) | Mobility ($cm^2/Vs$) | Ionic conductivity (mS/cm) |
|---|---|---|---|
| PCFA powder | −43.35 ± 0.48 | 3.40e−004 ± 00 | 0.028 ± 0.00042 |
| Kraft lignin | −42.05 ± 2.37 | −3.1e−04 ± 2.0E−06 | 0.6457 ± 0.00051 |

Figure 6:
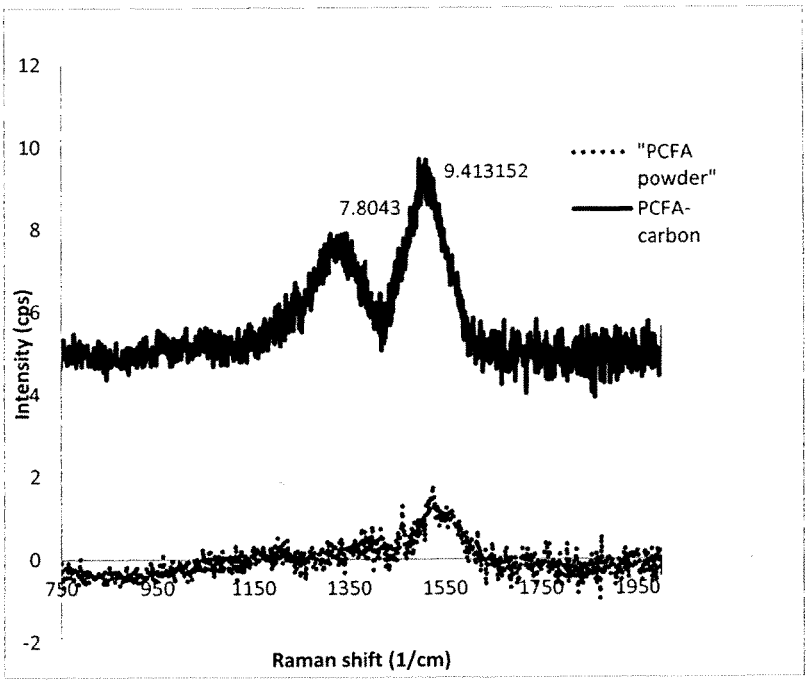
FIG. 6 shows Raman spectroscopy of (A) PCFA powder and derived carbon, and (B) Kraft lignin powder and derived carbon.
Figure 6:
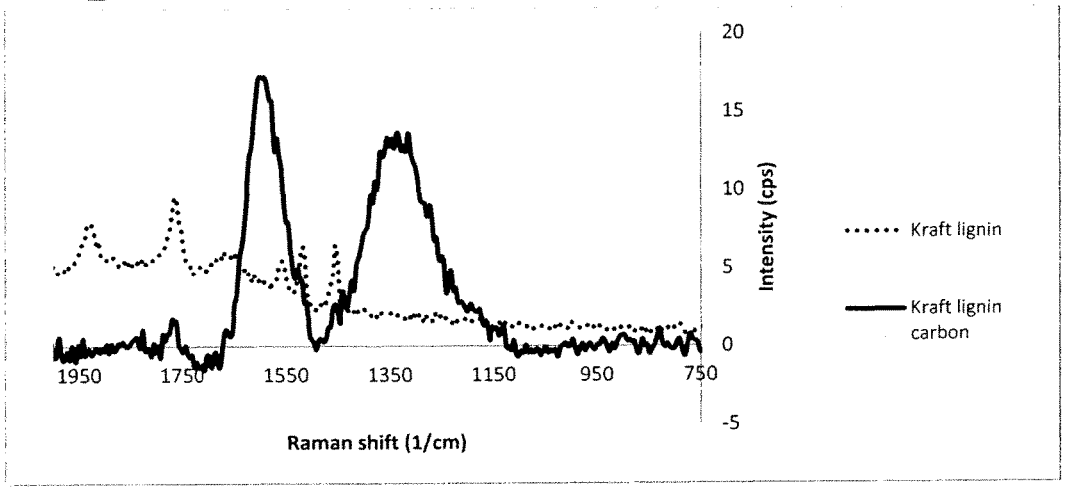

Raman spectroscopy was performed to compare the purity of carbon obtained from PCFA and Kraft lignin powder samples (FIG. 6). The D and G bands give the defect-derived structures and graphite derived structure of the carbon, respectively. The D band is due to the breathing modes of $sp^2$ atoms in the aromatic ring while the G band results from $sp^2$ site stretching of C═C bonds. A high G/D ratio is symptomatic of higher crystalline structure. Carbon from PAN has G/D ratios ranging from 0.57-0.67, while pitch-based carbon shows higher crystal perfection with G/D ratios ranging from 2.27 to 7.6. The G/D ratios of PCFA powder and PCFA carbon are 2.68 and 1.92, respectively (see Table 3 below). It is important to note that carbonization at 900° C. has increased the graphitic structure as seen by the intensity of the G-band (FIG. 6A). There is a 133% increase in highly ordered G-band. The G-band intensity can also be used to check the purity of the samples. This is because, unlike with the D band, there is no effect of chirality on the G-band. Thus the Raman spectra show that high purity carbon is obtained from PCFA, comparable to PAN. The highly ordered graphitic structure in PCFA-derived carbon is correlated to higher mechanical stiffness, thermal and electrical conductivity. Also, the unburnt Kraft lignin shows no presence of G and D bands, whereas the carbonized material shows a distinct presence of both bands (FIG. 6B). The G/D ratio is 1.15, indicating the presence of ordered graphitic structure. However, PCFA shows a higher carbon purity when produced with the carbonization method described in Example 4 above.

Table 3 below shows a comparison of the Raman spectral parameters of PCFA and Kraft lignin, before and after carbonization.

TABLE 3

| | PCFA powder | PCFA carbon | Kraft lignin | Kraft lignin carbon |
|---|---|---|---|---|
| G/D | 2.68 | 1.92 | — | 1.15 |
| D/G | 1.96 | 0.92 | — | 1.84 |
| G' | — | — | 2 | 0.57 |
| M | — | — | 7 | 0.3 |
| | Full Width Half Maximum (FWHM) of the related peaks | | | |
| G | 59 | 122 | — | 85 |
| D | 116 | 112 | — | 156 |
| G' | — | — | 58 | 30 |
| M | — | — | 31 | 40 |
| FWHM(D) × (D/G) | 227 | 103 | — | 287 |

What is claimed is:

1. A method for producing carbon fibers derived from poly-(caffeyl alcohol) (PCFA), comprising:

extracting poly-(caffeyl alcohol) (PCFA) from a plant to produce extracted PCFA; and electrospinning the extracted PCFA to produce carbon fibers, wherein the carbon fibers consist of 100 wt. % PCFA.

2. The method of claim 1, further comprising the step of carbonizing the carbon fibers.

3. The method of claim 2, wherein the carbonizing is carried out at 900° C.

4. The method of claim 1, wherein the step of electrospinning comprises preparing a 50% solution of the extracted PCFA in dioxane and electrospinning the solution through a syringe needle to which a voltage is applied.

5. The method of claim 1, wherein the plant is *Vanilla planifolia* or *Jatropha curcas*.

6. A method for producing carbon fibers derived from poly-(caffeyl alcohol) (PCFA), comprising:

extracting poly-(caffeyl alcohol) (PCFA) from a plant to produce extracted PCFA;

combining the extracted PCFA with a polymer carrier to produce a PCFA polymer mixture; and extruding the PCFA polymer mixture through an extruder to produce carbon fibers, wherein the carbon fibers comprise PCFA at about 10 wt. % to about 90 wt. %.

7. The method of claim 6, further comprising the step of carbonizing the carbon fibers.

8. The method of claim 7, wherein the carbonizing is carried out at 900° C.

9. The method of claim 6, wherein the plant is *Vanilla planifolia* or *Jatropha curcas*.

* * * * *